US008797185B2

(12) United States Patent
Cho et al.

(10) Patent No.: US 8,797,185 B2
(45) Date of Patent: Aug. 5, 2014

(54) DRIVING ASSITSTANCE METHOD, ON-BOARD UNIT (OBU) APPLYING THE METHOD AND COMPUTER READABLE STORAGE MEDIUM STORING THE METHOD

(75) Inventors: Cheng-Hsuan Cho, Hsinchu County (TW); Tang-Hsien Chang, Taipei (TW); Tzu-Chun Liu, Kaohsiung (TW); Bor-Chia Hsieh, Pingtung (TW)

(73) Assignee: Institute for Information Industry, Taipei (TW)

( * ) Notice: Subject to any disclaimer, the term of this patent is extended or adjusted under 35 U.S.C. 154(b) by 288 days.

(21) Appl. No.: 13/421,187

(22) Filed: Mar. 15, 2012

(65) Prior Publication Data

US 2012/0169517 A1 Jul. 5, 2012

(30) Foreign Application Priority Data

Nov. 30, 2011 (TW) ..... 100144051 A

(51) Int. Cl.
*G08G 1/00* (2006.01)
*G08G 1/0967* (2006.01)
*G08G 1/16* (2006.01)

(52) U.S. Cl.
CPC ..... *G08G 1/096783* (2013.01); *G08G 1/164* (2013.01)
USPC ..... 340/932; 340/932.2; 340/937; 340/905; 340/904; 340/928

(58) Field of Classification Search
USPC ..... 340/932.2, 937, 905, 904, 928
See application file for complete search history.

(56) References Cited

U.S. PATENT DOCUMENTS

| | | | | |
|---|---|---|---|---|
| 6,989,766 | B2 * | 1/2006 | Mese et al. | 340/907 |
| 2002/0126022 | A1 * | 9/2002 | Ellis | 340/901 |
| 2005/0134478 | A1 * | 6/2005 | Mese et al. | 340/901 |

FOREIGN PATENT DOCUMENTS

EP 2320403 A2 5/2011

* cited by examiner

*Primary Examiner* — Daryl Pope
(74) *Attorney, Agent, or Firm* — McClure, Qualey & Rodack, LLP

(57) ABSTRACT

An on-board unit (OBU) with a driving-assistance function to be installed on a vehicle includes at least one wireless communication unit and a processing unit. The processing unit receives information of at least one first traffic signal and at least one second traffic signal respectively from their RSUs through the at least one wireless communication unit. The first traffic signal is installed at a first intersection, the at least one second traffic signal is installed at a second intersection, and the vehicle is closer to the first intersection than to the second intersection. The processing unit generates a suggested speed range, within which the vehicle may travel to allow the same to pass through the first intersection and the second intersection without stopping, according to the information of at least one first traffic signal and the at least one second traffic and vehicle position information of the vehicle.

13 Claims, 4 Drawing Sheets

DRIVING ASSITSTANCE METHOD, ON-BOARD UNIT (OBU) APPLYING THE METHOD AND COMPUTER READABLE STORAGE MEDIUM STORING THE METHOD

RELATED APPLICATIONS

This application claims priority to Taiwan Application Serial Number 100144051, filed Nov. 30, 2010, which is herein incorporated by reference.

BACKGROUND

1. Technical Field

The present invention relates to a driving assistance method, an on-board unit (OBU) applying the method and a computer readable storage medium for storing the method.

2. Description of Related Art

Traffic signals are designed to enhance traffic safety and efficiency. If the timing scheme of a traffic signal is not well designed, vehicles may be unnecessarily stopped by red lights, which may slow overall traffic flow in an area, and in some instances, poor timing scheme design of a traffic signal may result in traffic accidents. With some designs, drivers may face dangerous situations since they can not figure out the switching time of traffic signals. For example, if the remaining time of a green light is not provided, it is hard for drivers to decide to pass through the intersection or stop, which may result in dangerous driving conditions. In addition, drivers may not know that if they should speed up or slow down, which may lead to traffic jams. Moreover, frequent stopping and starting may bring discomfort to passengers in vehicles.

Hence, the timing scheme of a traffic signal should be designed considering both efficiency and safety. If the timing scheme of a traffic signal is designed solely for efficiency, vehicles passing through the same may travel too fast without being stopped, which may cause accidents. If timing strategy of a traffic signal is designed solely for safety, the speed of vehicles may be lowered to an excessive degree, which may lead to traffic jams.

SUMMARY

According to one embodiment of this invention, an on-board unit (OBU) with a driving-assistance function is disclosed to generate a suggested speed range, driving within which a vehicle can avoid red lights at traffic lights installed at several intersections. The OBU is installed on a vehicle. The OBU includes at least one wireless communication unit and a processing unit, which are electrically connected with each other. The processing unit includes a traffic light information receiving module, a position obtaining module and a suggested speed generating module. The traffic light information receiving module receives information of at least one first traffic signal and at least one second traffic signal respectively from at least one first road side unit (RSU) and at least one second RSU through the at least one wireless communication unit. The at least one first traffic signal is installed at a first intersection, which is in a traveling direction of the vehicle, the at least one second traffic signal is installed at a second intersection, which is in the traveling direction, and the vehicle is closer to the first intersection than to the second intersection. The position obtaining module obtains vehicle position information of the vehicle. The suggested speed generating module generates a suggested speed range, within which the vehicle may travel to allow the same to pass through the first intersection and the second intersection without stopping, according to the information of the at least one first traffic signal and the at least one second traffic and the vehicle position information.

According to another embodiment of this invention, a driving assistance method is disclosed to generate a suggested speed range, driving within which a vehicle can avoid red lights of traffic lights installed at several intersections. The driving assistance method may take the form of a computer program product stored on a computer-readable storage medium having computer-readable instructions embodied in the medium. The driving assistance method includes the following operations:

(a) An OBU installed on a vehicle is utilized to receive information of at least one first traffic signal and at least one second traffic signal respectively from at least one first RSU and at least one second RSU. The at least one first traffic signal is installed at a first intersection, which is in a traveling direction of the vehicle, the at least one second traffic signal is installed at a second intersection, which is in the traveling direction, and the vehicle is closer to the first intersection than to the second intersection.

(b) The OBU is utilized to retrieve vehicle position information of the vehicle.

(c) A suggested speed range, within which the vehicle may travel to allow the same to pass through the first intersection and the second intersection without stopping, is generated according to the information of the at least one first traffic signal and the at least one second traffic and the vehicle position information.

The present invention can achieve many advantages. A suggested speed range is provided, and several intersections can be driven through without being stopped by red lights shown on traffic signals if a vehicle travels within the speed range. In other words, the vehicle does not need to be started and stopped due to the timing scheme of the traffic signals, and as a result, the passengers in the vehicle may feel greater comfort while traveling in the vehicle.

These and other features, aspects, and advantages of the present invention will become better understood with reference to the following description and appended claims. It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference made to the accompanying drawings as follows.

DETAILED DESCRIPTION

Figure 1:
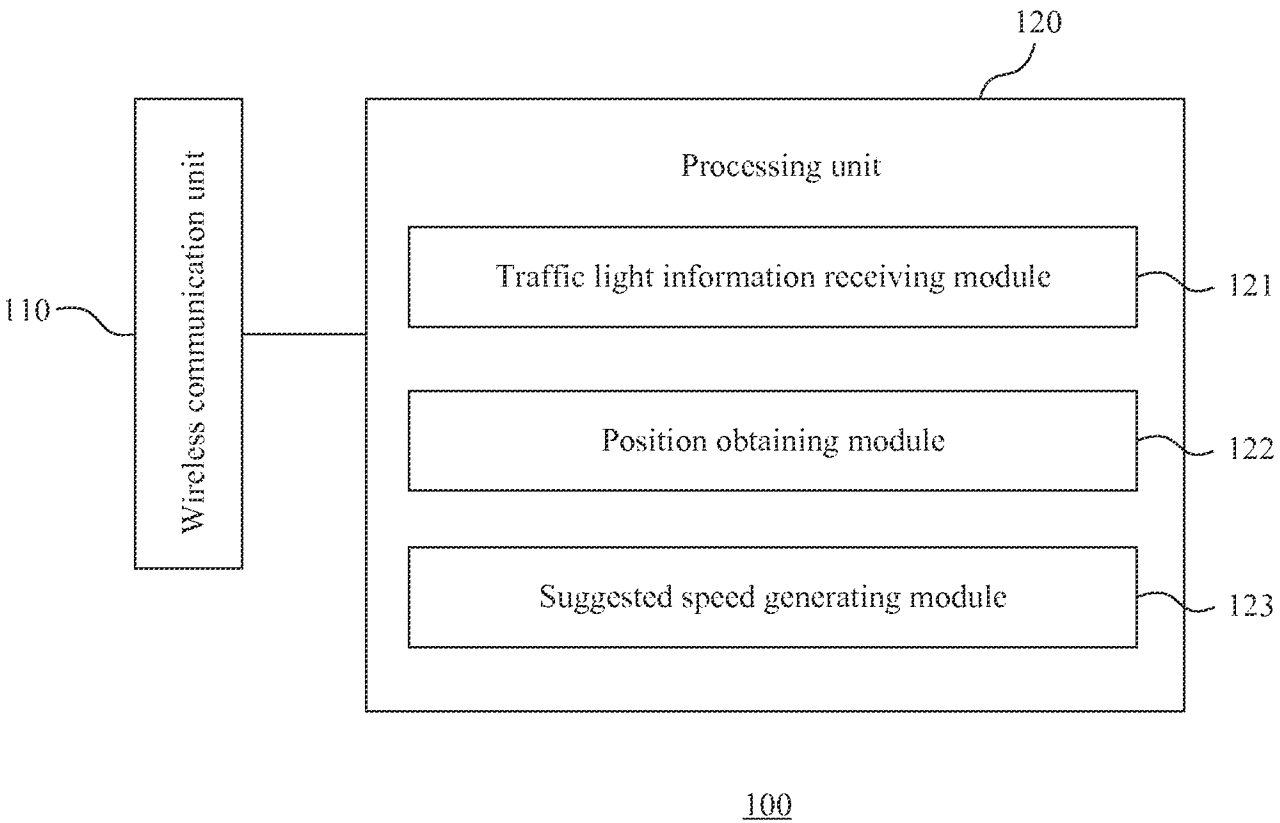
FIG. 1 illustrates a block diagram of an on-board unit (OBU) with a driving-assistance function according to an embodiment of this invention.

Reference will now be made in detail to the present embodiments of the invention, examples of which are illustrated in the accompanying drawings. Wherever possible, the same reference numbers are used in the drawings and the description to refer to the same or like parts.

Figure 2:
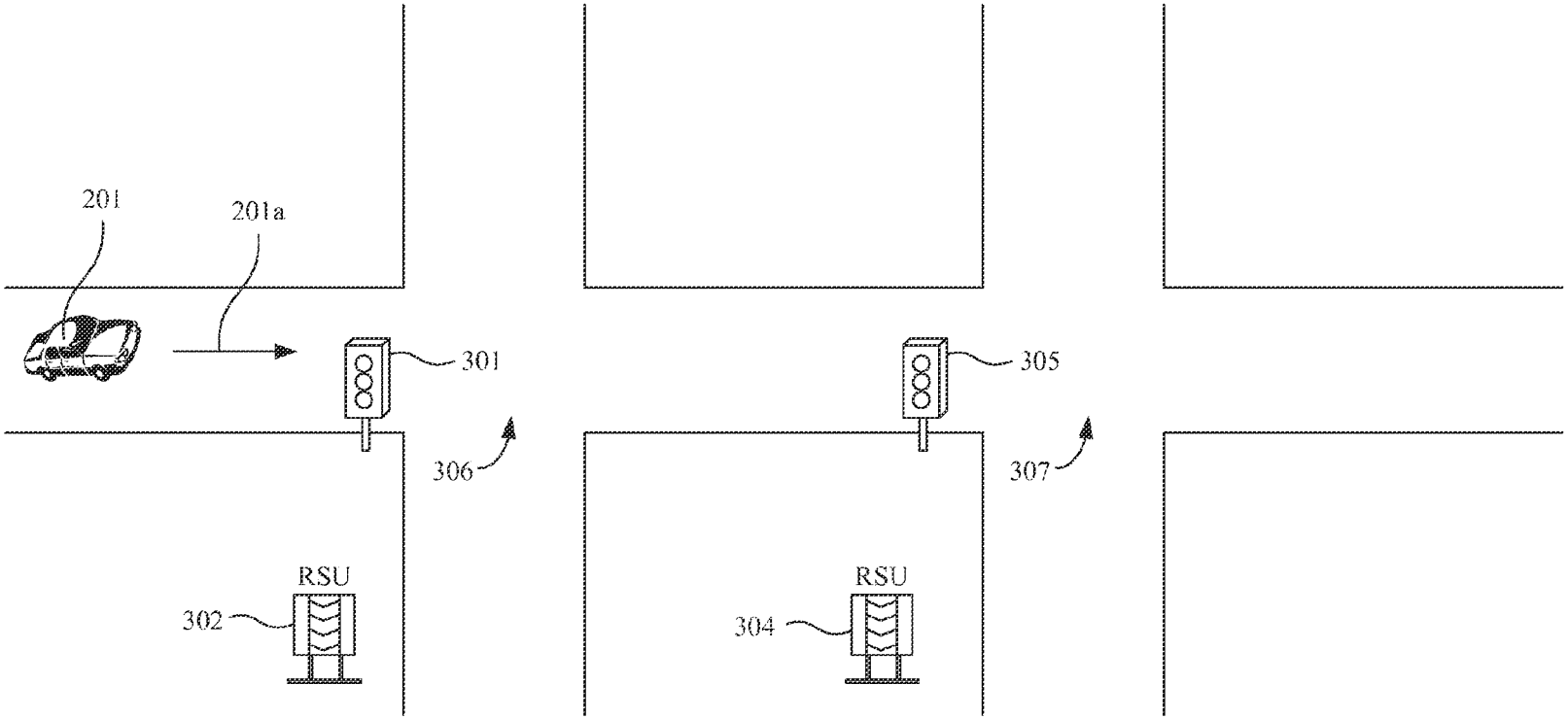
FIG. 2 illustrates a scenario applying an OBU of the present application.

FIG. 1 illustrates a block diagram of an on-board unit (OBU) 100 with a driving-assistance function according to an embodiment of this invention. FIG. 2 illustrates a scenario applying the OBU 100. The OBU 100 is utilized to generate a suggested speed range, driving within which a vehicle can avoid red lights generated at traffic lights installed at several intersections.

Referring to both FIG. 1 and FIG. 2, the OBU 100 can be installed on a vehicle 201. The OBU 100 includes at least one wireless communication unit 110 and a processing unit 120, which are electrically connected with each other. The wireless communication unit 110 follows at least one protocol selected from Worldwide Interoperability for Microwave Access (WiMax®), WiFi®, Zigbee®, Dedicated short-range communications (DSRC), 3rd-generation mobile telecommunications (3G), 4th-generation mobile telecommunications (4G), General packet radio service (GPRS), Long Term Evolution (LTE) and other wireless communication protocols for data transmission. In one embodiment of this invention, the wireless communication unit 110 may support DSRC for transmitting data in real time or with a short delay. In addition, the wireless communication unit 110 may support DSRC and other wireless communication protocols with a wide transmission area, such that the wireless communication unit 110 can transmit data in real time or with a short delay and towards a wide transmission area.

The processing unit 120 includes a traffic light information receiving module 121, a position obtaining module 122 and a suggested speed generating module 123. The traffic light information receiving module 121 receives information of a first traffic signal 301 and a second traffic signal 305 respectively from a first road side unit (RSU) 302 and a second RSU 304 through the at least one wireless communication unit 110. The first traffic signal 301 is installed at a first intersection 306, which is in a traveling direction 201*a* of the vehicle 201, the second traffic signal 305 is installed at a second intersection 307, which is in the traveling direction 201*a*, and the vehicle 201 with the OBU 100 is closer to the first intersection 306 than to the second intersection 307. The information of the first traffic signal 301 may include information about the present signal shown on the first traffic signal 301, the signal period of the first traffic signal 301, the remaining time of a green light or a red light shown on the first traffic signal 301 or any other information of the first traffic signal 301. The information of the second traffic signal 305 may include information about the present signal shown on the second traffic signal 305, the signal period of the second traffic signal 305, the remaining time of a green light or a red light shown on the second traffic signal 305 or any other information of the second traffic signal 305. In one embodiment of this invention, the first intersection 306 is the closest intersection in the traveling direction 201*a* of the vehicle 201, and the second intersection 307 is the second closest intersection in the traveling direction 201*a* of the vehicle 201.

The position obtaining module 122 obtains vehicle position information of the vehicle 201. The vehicle position information of the vehicle 201 may include the present position of the vehicle 201, the length of the road section where the vehicle 201 is positioned, the intersection length of the first intersection 306, the intersection length of the second intersection 307, the distance from the stop line of the first intersection 306 to the vehicle 201, the distance from the stop line of the second intersection 307 to the vehicle 201 or any other information about the position of the vehicle 201. In some embodiments, the position obtaining module 122 may obtain the vehicle position information of the vehicle 201 utilizing a global positioning system (GPS), Assisted Global Positioning System (AGPS), Wi-Fi Positioning System or any other positioning method.

The suggested speed generating module 123 generates a suggested speed range, and when the vehicle 201 travels in the suggested speed range, the vehicle is able to pass through the first intersection 306 and the second intersection 307 without stopping. The suggested speed range is generated according to the information of the first traffic signal 301 and the second traffic signal 305, and the vehicle position information. In some embodiments, the OBU 100 can notify a driver of the vehicle 201 of the suggested speed range through a display unit or a sound generated by a speaker. In subsequence, the driver can drive the vehicle 201 within the suggested speed range without being stopped by a red light shown on the first traffic signal 301 or the second traffic signal 305. In other words, the vehicle 201 does not need to be started and stopped due to the timing scheme of the first traffic signal 301 or the second traffic signal 305, and as a result, the passengers in the vehicle 201 may feel greater comfort while traveling in the vehicle 201. In some embodiments, the OBU 100 may receive information of other intersections in the traveling direction 201*a* of the vehicle 201, and this information of other intersections may additionally be used in calculating the suggested speed range. The OBU 100 may use the information of the intersections in a manner that takes into consideration distance to the vehicle (i.e., from closest to furthest) when calculating the suggested speed range. In some other embodiments, the traffic light information receiving module 121 may receive information of at least one first traffic signal and at least one second traffic signal respectively from at least one first RSU and at least one second RSU through the at least one wireless communication unit 110 for the suggested speed generating module 123 to perform calculation processing.

Figure 3:
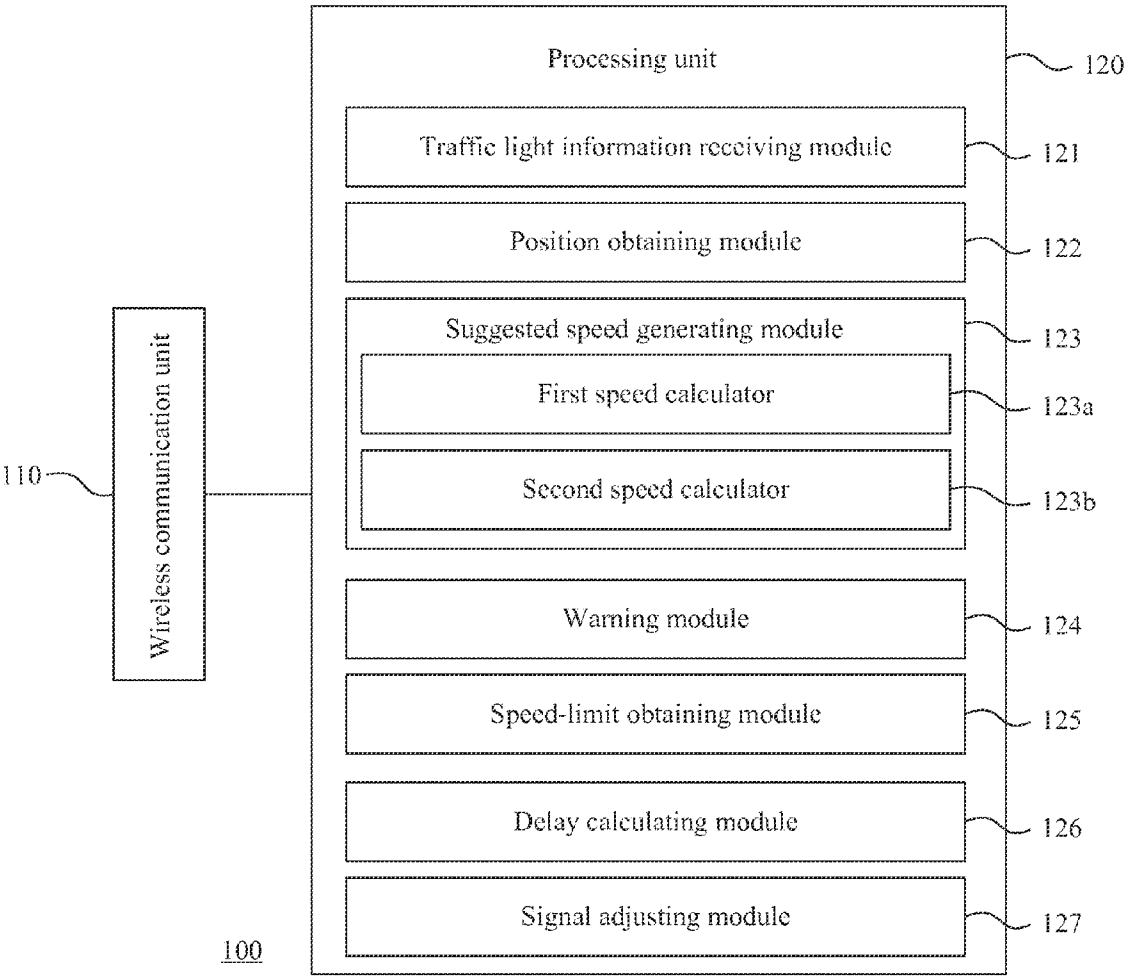
FIG. 3 illustrates a block diagram of an OBU with a driving-assistance function according to another embodiment of this invention.

Referring to FIG. 3, a block diagram will be described that illustrates an OBU 100 with a driving-assistance function according to another embodiment of this invention. It is to be understood that a description of elements identical to those mentioned above will not be repeated.

In one embodiment of this invention, the suggested speed generating module 123 may calculate speed ranges which would respectively allow the vehicle to pass through the first intersection 306 and the second intersection 307 without stopping, and these speed ranges may be used in a subsequent calculation of the suggested speed range. Hence, the suggested speed generating module 123 may include a first speed calculator 123*a* and a second speed calculator 123*b*. The first speed calculator calculates a first speed range, within which the vehicle 201 may travel to allow the same to pass through the first intersection 306 without stopping, according to the information of the first traffic signal 301 and the vehicle position information of the vehicle 201. In one embodiment, if the first traffic signal 301 shows a green light, the first speed calculator 123*a* may utilize the following formula to calculate a first highest speed and a first lowest speed:

$$V_{max} = \frac{x}{nC_1 - (G_1 - G_{remain1})}$$

$$V_{min} = \frac{x}{G_{remain1} + nC_1}$$

where $V_{max}$ is the first highest speed which is the highest speed for the vehicle 201 to pass through the first intersection 306 without stopping, x is the distance from the stop line of the first intersection 306 to the vehicle 201, n is a natural number, $C_1$ is the signal period of the first traffic signal 301, $G_1$ is the time period for a green light shown on the first traffic signal 301, $G_{remain1}$ is the remaining time for the present green light shown on the first traffic signal 301, and $V_{min}$ is the first lowest speed which is the lowest speed for the vehicle 201 to pass through the first intersection 306 without stopping.

In another embodiment of this invention, if the first traffic signal 301 shows a red light, the first speed calculator 123*a* may utilize the following formula to calculate a first highest speed and a first lowest speed:

$$V_{max} = \frac{x}{nC_1 + R_{remain1}}$$

$$V_{min} = \frac{x}{R_{remain1} + G_1 + nC_1}$$

where $V_{max}$ is the first highest speed which is the highest speed for the vehicle 201 to pass through the first intersection 306 without stopping, x is the distance from the stop line of the first intersection 306 to the vehicle 201, n is a natural number, $C_1$ is the signal period of the first traffic signal 301, $G_1$ is the time period for a green light shown on the first traffic signal 301, $R_{remain1}$ is the remaining time for the present red light shown on the first traffic signal 301, and $V_{min}$ is the first lowest speed which is the lowest speed for the vehicle 201 to pass through the first intersection 306 without stopping.

The second speed calculator 123*b* calculates a second speed range, within which the vehicle 201 may travel to allow the same to pass through the second intersection 307 without stopping, according to the information of the second traffic signal 305 and the vehicle position information of the vehicle 201. In some embodiments, the aforementioned formulas for the first speed calculator 123*a* can be used in slightly amended form by the second speed calculator 123*b* in calculating a second highest speed and a second lowest speed to generate the second speed range. In subsequence, the suggested speed generating module 123 takes an overlapping range of the first speed range and the second speed range as the suggested speed range.

In some embodiments, the processing unit 120 may further include a warning module 124. The warning module 124 may generate a warning signal if there is no overlapping range between the first speed range and the second speed range. For example, the warning module 124 may drive a speaker of the OBU 100 to generate a warning sound or drive a display unit of the OBU 100 to display a warning message for use as the warning signal. As a result, the driver of the vehicle 201 may be notified by the warning signal and then pay close attention to traffic signals ahead. Such a warning mechanism can help in preventing accidents.

In some embodiments, the processing unit 120 may further include a speed-limit obtaining module 125. The speed-limit obtaining module 125 obtains a present speed limit of the present road through the at least one wireless communication unit 110. In subsequence, the suggested speed generating module 123 takes a range within the overlapping range of the first speed range and the second speed range and that is further within the present speed limit as the suggested speed range. Therefore, a reasonable suggested speed range may be provided to the driver of the vehicle 201. In addition, when the overlapping range of the first speed range and the second speed range is not within the present speed limit, the warning module 124 may generate a warning signal to notify the driver of the vehicle 201. Therefore, if no reasonable speed range can be provided, a warning signal can be generated to notify the driver of the vehicle 201 to pay close attention to the traffic signals.

The processing unit 120 may further include a delay calculating module 126 and a signal adjusting module 127. The delay calculating module 126 calculates a first delay time for which the first traffic signal 301 must be delayed if the vehicle 201 is to pass through the first intersection 306 without stopping, and calculates a second delay time for which the second traffic signal 305 must be delayed if the vehicle 201 is to pass through the second intersection 307 without stopping. The delay calculating module 126 calculates the first and second delay times according to a present speed of the vehicle 201 and the vehicle position information.

The signal adjusting module 127 generates a signal adjust request according to the first delay time and the second delay time. In some embodiments, the signal adjusting module 127 may select the one with the larger value between the first delay time and the second delay time for use in generating the signal adjust request. In subsequence, the signal adjusting module 127 may transmit the signal adjust request to the first RSU 302 or the second RSU 304 through the at least one wireless communication unit 110 to adjust signal periods of the first traffic signal 301 or the second traffic signal 305. In some embodiments, such signal period adjustment may be performed by extending the remaining time of green lights or red lights, which are shown on the first traffic signal 301 or the second traffic signal 305. Therefore, the vehicle 201 may pass through the intersections 306, 307 without stopping.

Figure 4:
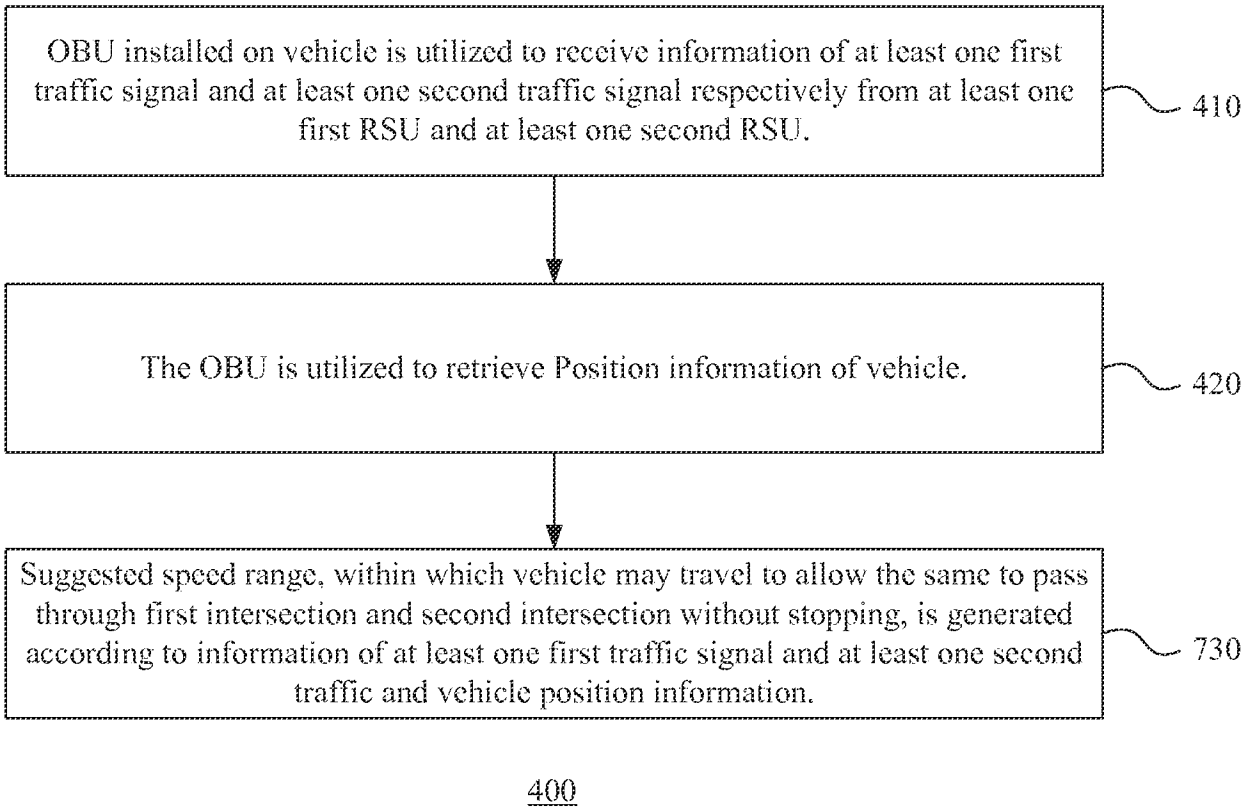
FIG. 4 is a flow diagram of a driving assistance method according to one embodiment of this invention.

Referring to FIG. 4, a flow diagram will be described that illustrates a driving assistance method according to one embodiment of this invention. In the driving assistance method, a suggested speed range, driving within which a vehicle can avoid red lights at traffic lights installed at several intersections, is generated. The driving assistance method may take the form of a computer program product stored on a computer-readable storage medium having computer-readable instructions embodied in the medium. Any suitable storage medium may be used including non-volatile memory such as read only memory (ROM), programmable read only memory (PROM), erasable programmable read only memory (EPROM), and electrically erasable programmable read only memory (EEPROM) devices; volatile memory such as static random access memory (SRAM), dynamic random access memory (DRAM), and double data rate random access memory (DDR-RAM); optical storage devices such as compact disc read only memories (CD-ROMs) and digital versatile disc read only memories (DVD-ROMs); and magnetic storage devices such as hard disk drives (HDD) and floppy disk drives.

The routine 400 of the driving assistance method starts at operation 410, where an OBU installed on a vehicle is utilized to receive information of at least one first traffic signal and at least one second traffic signal respectively from at least one first RSU and at least one second RSU. The at least one first traffic signal is installed at a first intersection, which is in a traveling direction of the vehicle, the at least one second traffic signal is installed at a second intersection, which is in the traveling direction, and the vehicle is closer to the first intersection than to the second intersection. The OBU may receive the information of the traffic signals through at least one protocol selected from WiMax®, WiFi®, Zigbee®, DSRC, 3G, 4G, GPRS, LTE and other wireless communication protocols. In one embodiment of operation 410, the OBU may support DSRC to receive the information of the traffic signals with a short delay. In addition, the OBU may support DSRC and other wireless communication protocols with a wide transmission area, such that the OBU can transmit data in real time or with a short delay and towards a wide transmission area. The information of the first traffic signal may include the information about the present signal shown on the at least one first traffic signal, the signal period of the at least one first traffic signal, the remaining time of a green light or a red light shown on the at least one first traffic signal or any other information of the at least one first traffic signal. The information of the at least one second traffic signal may include the information about the present signal shown on the at least one second traffic signal, the signal period of the at least one second traffic signal, the remaining time of a green light or a red light shown on the at least one second traffic signal or any other information of the at least one second traffic signal.

The routine 400 of the driving assistance method continues to operation 420, where the OBU is utilized to retrieve vehicle position information of the vehicle installed with the OBU is obtained. The vehicle position information of the vehicle may include the present position of the vehicle, the length of the road section where the vehicle is positioned, the intersection length of the first intersection, the intersection length of the second intersection, the distance from the stop line of the first intersection to the vehicle, the distance from the stop line of the second intersection to the vehicle or any other information about the position of the vehicle. In some embodiments of operation 420, the vehicle position information of the vehicle may be obtained through GPS, AGPS, Wi-Fi Positioning System or any other positioning method.

In subsequence, the routine 400 of the driving assistance method continues to operation 430, where a suggested speed range, within which the vehicle may travel to allow the same to pass through the first intersection and the second intersection without stopping, is generated according to the above information of the at least one first traffic signal and the at least one second traffic and the vehicle position information. In some embodiments, the OBU can notify a driver of the vehicle of the suggested speed range through a display unit or a sound generated by a speaker. In subsequence, the driver can drive the vehicle within the suggested speed range without being stopped by a red light shown on the at least one first traffic signal or the at least one second traffic signal. In other words, the vehicle does not need to be started and stopped due to the timing scheme of the traffic signals, and as a result, the passengers in the vehicle may feel greater comfort while traveling in the vehicle. In some embodiments, information of other intersections in the traveling direction of the vehicle may be received and also used in calculating the suggested speed range. The information of the intersections may be used in a manner that takes into consideration distance to the vehicle (i.e., from closest to furthest) for the calculation of the suggested speed range.

In one embodiment of operation 430, a first speed range, within which the vehicle may travel to allow the same to pass through the first intersection without stopping, may be calculated according to the information of the first traffic signal and the vehicle position information of the vehicle. In addition, a second speed range, within which the vehicle may travel to allow the same to pass through the second intersection without stopping, may be generated according to the information of the second traffic signal and the vehicle position information of the vehicle. In subsequence, an overlapping range of the first speed range and the second speed range may be taken as the suggested speed range at operation 430. Furthermore, if there is no overlapping range between the first speed range and the second speed range, a warning signal may be generated. For example, a speaker of the OBU may be driven to generate a warning sound or a display unit of the OBU may be driven to display a warning message for use as the warning signal. As a result, the driver of the vehicle may be notified by the warning signal and then pay close attention to traffic signals ahead. Such a warning mechanism can help in preventing accidents.

In some embodiments, the routine 400 of the driving assistance method may further perform operations where a present speed limit of the present road may be obtained through the at least one wireless communication interface. Subsequently, in one embodiment of operation 430, a range within the overlapping range of the first speed range and the second speed range and that is further within the present speed limit may be taken as the suggested speed range. Therefore, the suggested speed range may be reasonable. In addition, when the overlapping range of the first speed range and the second speed range is not within the present speed limit, a warning signal may be generated to notify the driver of the vehicle. Therefore, if no reasonable speed range can be provided, a warning signal can be generated to notify the driver of the vehicle to pay close attention to the traffic signals.

In some embodiments, signal periods can be adjusted in the driving assistance method. Hence, the routine 400 of the driving assistance method may further include operations where a first delay time, for which the first traffic signal must be delayed if the vehicle is to pass through the first intersection without stopping, and a second delay time, for which the second traffic signal must be delayed if the vehicle is to pass through the second intersection without stopping, may be calculated according to a present speed of the vehicle and the vehicle position information. In subsequence, a signal adjust request may be generated according to the first delay time and the second delay time. In some embodiments, the one with the larger value between the first delay time and the second delay time may be used in generating the signal adjust request. Next, the OBU may transmit the signal adjust request to the first RSU or the second RSU to adjust signal periods of the first traffic signal or the second traffic signal. In some embodiments, such signal period adjustment may be performed by extending the remaining time of green lights or red lights, which are shown on the first traffic signal or the second traffic signal. Therefore, the vehicle may pass through the intersections without stopping.

The present invention can achieve many advantages. A suggested speed range is provided, and several intersections can be driven through without being stopped by red lights shown on traffic signals if a vehicle travels within the speed range. In other words, the vehicle does not need to be started and stopped due to the timing scheme of the traffic signals, and as a result, the passengers in the vehicle may feel greater comfort while traveling in the vehicle.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An on-board unit (OBU) with a driving-assistance function, wherein the OBU is installed on a vehicle, and the OBU comprises:

at least one wireless communication unit; and a processing unit electrically connected with the at least one wireless communication unit, wherein the processing unit comprises:

a traffic light information receiving module for receiving information of at least one first traffic signal and at least one second traffic signal respectively from at least one first road side unit (RSU) and at least one second RSU through the at least one wireless communication unit, wherein the at least one first traffic signal is installed at a first intersection, which is in a traveling direction of the vehicle, the at least one second traffic signal is installed at a second intersection, which is in the traveling direction, and the vehicle is closer to the first intersection than to the second intersection;

a position obtaining module for obtaining vehicle position information of the vehicle; and a suggested speed generating module for generating a suggested speed range, within which the vehicle may travel to allow the same to pass through the first intersection and the second intersection without stopping, the suggested speed range being generated according to the information of the at least one first traffic signal and the at least one second traffic and the vehicle position information, wherein the processing unit further comprises:

a delay calculating module for calculating a first delay time for which the at least one first traffic signal must be delayed if the vehicle is to pass through the first intersection without stopping, and calculating a second delay time for which the at least one second traffic signal must be delayed if the vehicle is to pass through the second intersection without stopping, the first delay time and the second delay time being calculated according to a present speed of the vehicle and the vehicle position information; and a signal adjusting module for generating a signal adjust request according to the first delay time and the second delay time, and transmitting the signal adjust request to the at least one first RSU and the at least one second RSU through the at least one wireless communication unit to adjust signal periods of the at least one first traffic signal and the at least one second traffic signal.

2. The OBU of claim 1, wherein the suggested speed generating module comprises:

a first speed calculator for calculating a first speed range, within which the vehicle may travel to allow the same to pass through the first intersection without stopping, the first speed range being calculated according to the information of the at least one first traffic signal and the vehicle position information; and a second speed calculator for calculating a second speed range, within which the vehicle may travel to allow the same to pass through the second intersection without stopping, the second speed range being calculated according to the information of the at least one second traffic signal and the vehicle position information;

wherein the suggested speed generating module takes an overlapping range of the first speed range and the second speed range as the suggested speed range.

3. The OBU of claim 2, wherein the processing unit further comprises:

a warning module for generating a warning signal if there is no overlapping range between the first speed range and the second speed range.

4. The OBU of claim 2, wherein the processing unit further comprises:

a speed-limit obtaining module for obtaining a present speed limit through the at least one wireless communication unit, wherein the suggested speed generating module takes a range within the overlapping range of the first speed range and the second speed range and that is further within the present speed limit as the suggested speed range.

5. The OBU of claim 4, wherein the processing unit further comprises:

a warning module for generating a warning signal when the overlapping range of the first speed range and the second speed range is not within the present speed limit.

6. The OBU of claim 1, wherein number of the at least one wireless communication unit is more than one.

7. The OBU of claim 6, wherein the wireless communication unit follows protocols selected from Worldwide Interoperability for Microwave Access (WiMax®), WiFi®, Zigbee®, Dedicated short-range communications (DSRC), 3rd-generation mobile telecommunications (3G), 4th-generation mobile telecommunications (4G), General packet radio service (GPRS), and Long Term Evolution (LTE) for data transmission.

8. A driving assistance method comprising:

(a) utilizing an OBU installed on a vehicle to receive information of at least one first traffic signal and at least one second traffic signal respectively from at least one first road side unit (RSU) and at least one second RSU, wherein the at least one first traffic signal is installed at a first intersection, which is in a traveling direction of the vehicle, the at least one second traffic signal is installed at a second intersection, which is in the traveling direction, and the vehicle is closer to the first intersection than to the second intersection;

(b) utilizing the OBU to retrieve vehicle position information of the vehicle; and (c) generating a suggested speed range, within which the vehicle may travel to allow the same to pass through the first intersection and the second intersection without stopping, the suggested speed range being generated according to the information of the at least one first traffic signal and the at least one second traffic and the vehicle position information; wherein the driving assistance method further comprises:

calculating a first delay time for which the at least one first traffic signal must be delayed if the vehicle is to pass through the first intersection without stopping, and calculating a second delay time for which the at least one second traffic signal must be delayed if the vehicle is to pass through the second intersection without stopping, the first delay time and the second delay time being calculated according to a present speed of the vehicle and the vehicle position information;

generating a signal adjust request according to the first delay time and the second delay time; and utilizing the OBU to transmit the signal adjust request to the at least one first RSU and the at least one second RSU to adjust signal periods of the at least one first traffic signal and the at least one second traffic signal.

9. The driving assistance method of claim 8, wherein operation (c) comprises:

calculating a first speed range, within which the vehicle may travel to allow the same to pass through the first intersection without stopping, the first speed range being calculated according to the information of the at least one first traffic signal and the vehicle position information;

calculating a second speed range, within which the vehicle may travel to allow the same to pass through the second intersection without stopping, the second speed range being calculated according to the information of the at least one second traffic signal and the vehicle position information; and taking an overlapping range of the first speed range and the second speed range as the suggested speed range.

10. The driving assistance method of claim 9 further comprising:

generating a warning signal if there is no overlapping range between the first speed range and the second speed range.

11. The driving assistance method of claim 9 further comprising:

obtaining a present speed limit, wherein operation (c) comprises:

taking a range within the overlapping range of the first speed range and the second speed range and that is further within the present speed limit as the suggested speed range.

12. The driving assistance method of claim 11 further comprising:

generating a warning signal when the overlapping range of the first speed range and the second speed range is not within the present speed limit.

13. A computer readable storage medium with a computer program to execute a driving assistance method, wherein the driving assistance method comprises:

(a) utilizing an OBU installed on a vehicle to receive information of at least one first traffic signal and at least one second traffic signal respectively from at least one first road side unit (RSU) and at least one second RSU, wherein the at least one first traffic signal is installed at a first intersection, which is in a traveling direction of the vehicle, the at least one second traffic signal is installed at a second intersection, which is in the traveling direction, and the vehicle is closer to the first intersection than to the second intersection;

(b) utilizing the OBU to retrieve vehicle position information of the vehicle; and (c) generating a suggested speed range, within which the vehicle may travel to allow the same to pass through the first intersection and the second intersection without stopping, the suggested speed range being generated according to the information of at least one first traffic signal and the at least one second traffic and the vehicle position information; wherein the driving assistance method further comprises:

calculating a first delay time for which the at least one first traffic signal must be delayed if the vehicle is to pass through the first intersection without stopping, and calculating a second delay time for which the at least one second traffic signal must be delayed if the vehicle is to pass through the second intersection without stopping, the first delay time and the second delay time being calculated according to a present speed of the vehicle and the vehicle position information;

generating a signal adjust request according to the first delay time and the second delay time; and utilizing the OBU to transmit the signal adjust request to the at least one first RSU and the at least one second RSU to adjust signal periods of the at least one first traffic signal and the at least one second traffic signal.

* * * * *